United States Patent [19]

Lane

[11] Patent Number: 4,991,327

[45] Date of Patent: Feb. 12, 1991

[54] CARD DISPLAY

[76] Inventor: Frances R. Lane, 37072 Cochise, Mount Clemens, Mich. 48043

[21] Appl. No.: 356,218

[22] Filed: May 24, 1989

[51] Int. Cl.[5] ..... G09F 1/10

[52] U.S. Cl. ..... 40/124; 40/124.4; 40/514

[58] Field of Search ..... 40/124, 124.4, 535, 40/536, 537, 493, 508, 514, 515, 617, 152, 152.1; 160/10, 23.1, 237, DIG. 11; 211/13; 24/703.6, 563

[56] References Cited

U.S. PATENT DOCUMENTS

| | | | |
|---|---|---|---|
| 58,270 | 9/1866 | Marks | 40/124 |
| 452,728 | 5/1891 | Parkinson | 40/124 |
| 933,500 | 9/1909 | Towle | 40/124 |
| 1,146,231 | 7/1915 | Arant | 24/703.6 |
| 1,238,988 | 9/1917 | Connor | 40/124 |
| 1,544,702 | 7/1925 | Trifari | 160/DIG. 11 |
| 2,140,049 | 12/1938 | Grauel | 160/237 |
| 2,802,250 | 8/1957 | Klutz | 24/343 |
| 3,083,427 | 4/1963 | Grenon | 24/343 |
| 3,134,185 | 5/1964 | Coats | 40/124.4 |
| 3,263,347 | 8/1966 | McCutcheon | 40/124 |
| 3,462,867 | 8/1969 | Pinkman et al. | 40/517 |
| 3,531,879 | 10/1970 | Bogese | 40/124.4 |
| 4,398,585 | 8/1983 | Marlow | 160/23.1 |
| 4,425,724 | 1/1984 | Scott | 40/124 |
| 4,654,988 | 4/1987 | Ericksen | 40/124 |
| 4,658,524 | 4/1987 | Jackson et al. | 40/493 |

*Primary Examiner*—Kenneth J. Dorner
*Assistant Examiner*—Brian K. Green
*Attorney, Agent, or Firm*—Brooks & Kushman

[57] ABSTRACT

A card display apparatus (10) for mounting greeting cards (11) is disclosed which comprises a mounting member (12) and an adjustable strip (14) having perforations (16) therein. The strip (14) is mountable on and is extendable from and retractable into the mounting member (12). A fastener (18) fastens a card (11) to one of the perforations (16) in the strip (14) to display the card.

4 Claims, 1 Drawing Sheet

CARD DISPLAY

TECHNICAL FIELD

This invention relates to a card display apparatus and, more particularly, to a space-saving adjustable greeting card display apparatus.

BACKGROUND ART

Card display apparatus are used to mount greeting cards so that the displayed cards are organizationally arranged and accessible for viewing.

Some conventional card display apparatus require significant space as substantial support structure is provided. Other apparatus require further assembly as additional cards are added to the display. Furthermore, many typical card displaying apparatus only accommodate cards of a select size and do not provide for opening the displayed cards outwardly for reading.

U.S. Pat. No. 4,052,805 to Potter discloses a card and bulletin displayer, including a plurality of vertically extending straps mounted on an adjustable frame.

U.S. Pat. No. 3,371,438 to Larrington discloses a work scheduling apparatus for mounting a plurality of work order cards in spaced relationship.

U.S. Pat. No. 3,327,419 to Stanos discloses a card-mounting and display apparatus wherein an elongated section or strip of curly pile fabric is hung from a supporting object and cards to be displayed have a complementary section of material attached thereon.

U.S. Pat. No. 2,278,695 to Fluss discloses a card hanger of an elongated strip, including a rubber suction cup to attach the strip to a wall.

U.S. Pat. No. 1,196,332 to Cabell, Jr. discloses a postcard or picture hanger, including a pair of strips having stamped end tongues thereon forming clamps for mounting the cards.

DISCLOSURE OF THE INVENTION

An object of the present invention is to provide an improved card display apparatus which is economical to manufacture and compact for mounting it on a wall or other supporting surface.

Another object of the present invention is to provide a card display apparatus wherein the apparatus is adjustable for displaying a few to many greeting cards and is completely retractable when not in use.

A further object of the invention is to provide a card display that permits mounting of cards of different sizes.

A still further object of the invention is to provide a card display apparatus which provides for opening displayed cards outwardly for reading.

In carrying out the above objects and other objects of the invention, the improved card display apparatus comprises a mounting member and a strip having perforations in the strip. The strip is mountable on and extendable from the mounting member. A fastener is fastenable to one of the perforations in the strip. The fastener is also fastenable to the card to be displayed to connect the card to the strip, displaying the card.

In a preferred embodiment of the invention, the mounting member is a housing from which the perforated strip is dispensable and retractable. The housing includes an axle mountable in the housing for rotational movement. The perforated strip is wound on the axle to thereby allow the strip to be dispensed or retracted as the axle is rotated.

The preferred housing includes two pairs of opposed side walls and also back and front walls. The back wall is used for mounting the card display apparatus to a wall or other vertical surface on which the housing is mounted. One of the side walls is horizontally disposed and includes a slit in it through which the perforated strip is dispensed or retracted.

The housing further includes a friction element. The friction element is generally disposed in close proximity to the slit for frictionally maintaining the perforated strip at a selected dispensed or retracted length. Most preferably, the frictional element is comprised of a frictional material.

Also in the preferred embodiment of the invention, the axle includes a crank mounted on the axle for manually actuating rotation of the axle. This rotational movement of the axle rewinds a length of dispensed perforated strip onto the axle. Preferably, the fastener for fastening the card to be displayed on the perforated strip is a round head fastener that can be attached through the card. Most preferably the fastener is a clamp-hook combination which can be used to clamp the card with the clamp part and hook the hook through a perforation in the strip.

The objects, features, and advantages of the present invention are readily apparent from the following detailed description of the best mode for carrying out the invention when taken with the accompanying drawings.

BEST MODE FOR CARRYING OUT THE INVENTION

Figure 1:
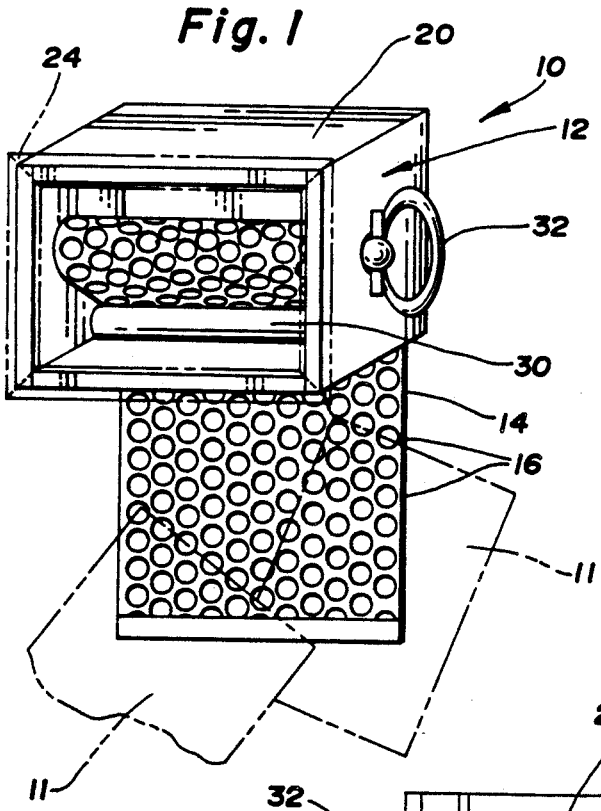
FIG. 1 is a perspective view of a card display apparatus constructed in accordance with the present invention.

With reference to FIG. 1 of the drawings, a card displaying apparatus, constructed in accordance with the present invention, is generally indicated by 10 and is used to display greeting cards 11, such as Christmas cards, or post cards or pictures, etc. in the use position illustrated. As is more fully hereinafter described, the card displaying apparatus 10 is compact and adjustable so that it can accommodate greeting cards or other similar items of different sizes.

As shown in FIG. 1 of the drawings, the card display apparatus 10 includes a mounting member 12, illustrated as a generally rectangular housing. A strip 14, having perforations 16 therein, is mountable on and extendable from the housing or mounting member 10. A fastener 18 is fastenable to one of the perforations in the strip 14 and is also fastenable to the card to thereby connect the card to the strip to display the card.

Figure 3:
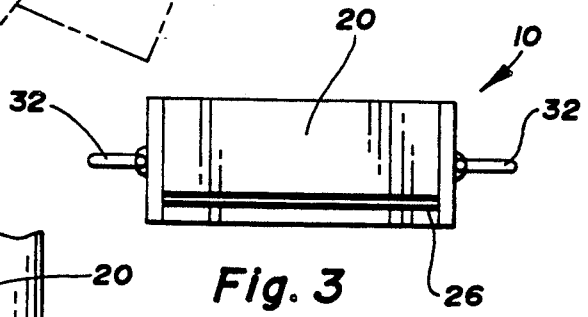
FIG. 3 is a bottom plan view of the card display apparatus illustrating a slit in a horizontally disposed side wall.

With further reference to FIG. 1 of the drawings, the housing includes two pairs of opposed side walls 20 and also back and front walls 22, 24. The front wall 24, illustrated in phantom, is preferably decorative and pleasing to look at as it is constantly viewable if the apparatus 10 is mounted. As illustrated, front wall 24 is a frame for a picture or other indicia to be displayed. The back wall 22 mounts the housing 12 on a mounting surface such as a wall or other flat surface. One of the side walls 20 is horizontally disposed and includes a slit 26 through which the perforated strip 14 is dispensed. Slit 26 is best seen in the bottom plan view of FIG. 3.

Figure 2:
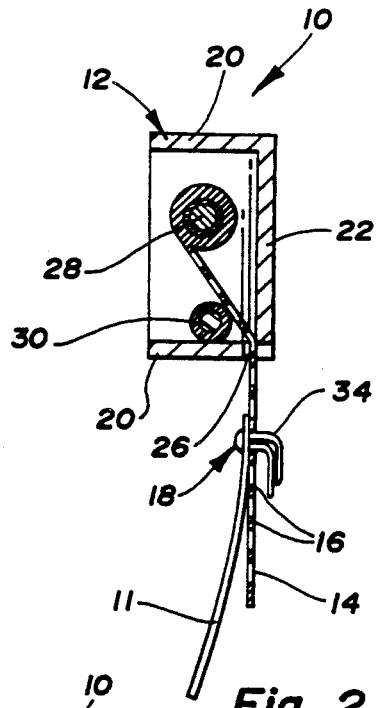
FIG. 2 is a sectional side elevational view of the card display apparatus.

With reference to FIG. 2 of the drawings, mounting member 12 includes an axle 28 mountable in the housing for rotational movement. Perforated strip 14 is wound on axle 28 to thereby allow the strip to be dispensed as the axle is rotated in one direction. Rotation of the axle 28 in the opposite direction rewinds the strip 14 on the axle, thereby decreasing the length of the dispensed strip.

With continued reference to FIG. 2 of the drawings, housing 12 further includes a friction element 30 mounted adjacent the slit 26 in the horizontally disposed side wall 20 for frictionally maintaining the perforated strip 14 at a selected dispensed length. In a preferred embodiment of the invention, the frictional element 30 is comprised of a frictional material that inhibits movement of the strip 14 relative to the frictional element. Most preferably, the friction element 30 is a felt-covered dowel.

With further reference to FIG. 1 of the drawings, axle 28 includes a crank 32 mounted on the axle for manually actuating rotation of the axle. For symmetry and aesthetic appeal, the crank 32 is mounted on either end of axle 28. The frictional effect of the friction element 30 is easily overcome through the manual application of force on the strip 14 in a downward direction Crank 32 is manually actuated to coil strip 14 to cause it to be retracted into the housing 12.

Figure 4:
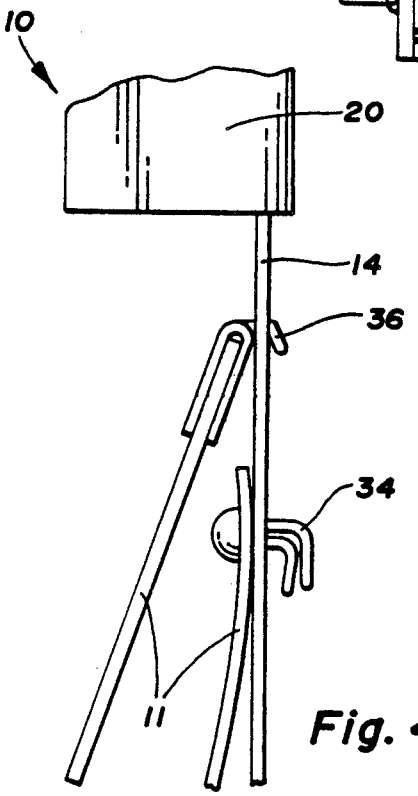
FIG. 4 is a side view of a perforated strip illustrating greeting cards fastened to the strip by fasteners.
Figure 6:
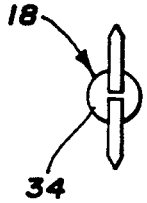
FIG. 6 is an elevational view of a round head fastener.

In FIG. 4 of the drawings, two fasteners 18 are illustrated for fastening a card 11 or picture or post card to the perforated strip 14. Preferably a round head fastener 34, shown in FIG. 6, is utilized. Preferably the round head fastener 34 is a No. 3 round head fastener, ¾" in length. Round head fastener 34 is attached to the card 11 to be hung by inserting one tip of the fastener through the card and then bending the tip down flush against the card and then hooking it with the card attached through a perforation 16 in strip 14, mounting the card.

Figure 5:
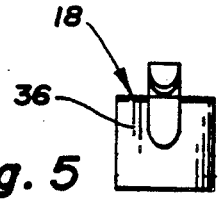
FIG. 5 is an elevational view of a combination clamp-hook fastener.

In the most preferred embodiment of the invention, fastener 18 is a combination clamp-hook fastener 36, shown in FIG. 5. Use of the combination clamp-hook fastener 36 avoids the necessity of having to penetrate the material of the card 11 or object to be hung. Combination clamp-hook fastener 36 is simply clamped onto the card 11 to be hung and then the hook is inserted through a perforation 16 in the strip 18. Other attaching means are readily contemplated for attaching the card 11 to strip 14.

While the best mode for carrying out the invention has been described in detail, those familiar with the art to which this invention relates will recognize alternative ways of practicing the invention as defined by the following claims.

What is claimed is:

1. A wall hanging adapted for displaying a variable number of cards, said wall hanging comprising:

a housing having side walls and a back wall, one of the side walls having a slit therein and another of the side walls having a hole formed therein, said side walls forming a front opening, said front opening having a width and height substantially the same as that of the back wall;

a roller rotatably mounted in said housing and having one end thereof extending through said hole;

a card support strip attached at one end to said roller and having its other end extending through said slot;

a crank on the end of said roller extending through said hole and operable to rotate said roller to wind up said support strip onto said roller, said support strip being adapted to be manually pulled down;

a dowel fixed in said housing to one of said side wall and having a friction material thereon, the friction material being spaced from said roller but sufficiently close to said slot to maintain the said support strip at any position to which it is pulled down;

said card support strip having a plurality of perforations coextensive therewith; and a fastener adapted to cooperate with a selected one of said perforations to display a selected one of said variable number of cards on said support strip.

2. The wall hanging of claim 1 wherein the front opening formed by said side walls is adapted to be covered by a picture or other indicia.

3. The wall hanging as in claim 1 wherein said fastener includes a head portion and integral leg portion; said leg portion extendable through and cooperable with the selected one of said perforations.

4. The wall hanging as in claim 3 wherein said head portion is a spring clamp.

* * * * *